United States Patent [19]

Colby

[11] 4,234,226

[45] Nov. 18, 1980

[54] ADJUSTABLE AND COLLAPSIBLE SEATING PIECE

[75] Inventor: Donald B. Colby, Los Angeles, Calif.

[73] Assignee: Scott Paper Company, Philadelphia, Pa.

[21] Appl. No.: 947,644

[22] Filed: Oct. 2, 1978

[51] Int. Cl.[3] ..... A47C 4/00

[52] U.S. Cl. ..... 297/21; 297/441; 297/457; 297/16; 297/45

[58] Field of Search ..... 297/21, 441, 16, 45, 297/92, 130, 134, 457, 440, 326, 327, 328, 445

[56] References Cited

U.S. PATENT DOCUMENTS

| | | | |
|---|---|---|---|
| 2,675,857 | 4/1954 | Bloom | 297/326 X |
| 2,779,389 | 1/1957 | Pearl | 297/327 |
| 3,230,011 | 1/1966 | Propst | 297/441 |
| 3,378,259 | 4/1968 | Kupchinski | 297/441 UX |
| 3,655,239 | 4/1972 | Agosti | 297/440 X |
| 3,754,788 | 8/1973 | Martini | 297/445 |
| 3,851,914 | 12/1974 | Nii | 297/457 |
| 3,917,312 | 11/1975 | Rodaway | 297/130 |
| 4,049,314 | 9/1977 | McGaffin | 297/441 X |
| 4,112,855 | 9/1978 | Colby | 108/159 |

FOREIGN PATENT DOCUMENTS

| | | | |
|---|---|---|---|
| 191118 | 2/1956 | Austria | 297/441 |
| 749223 | 5/1956 | United Kingdom | 297/441 |

*Primary Examiner*—Roy D. Frazier
*Assistant Examiner*—Peter A. Aschenbrenner
*Attorney, Agent, or Firm*—Martin L. Faigus; William J. Foley

[57] ABSTRACT

A seating piece, such as a chaise longue, includes a foldable base unit and a seating unit. The base unit includes side frame members that are rotatable into a generally horizontal, collapsible position, and into a laterally spaced-apart, generally vertical position. The seating unit includes a seat section and a back section rotatably joined together to permit adjustment of the seat and back sections relative to each other; the seating unit including connecting means for releasably engaging the side frame members when these frame members are in their generally vertical position and releasably connecting the seating unit to the base unit without preventing rotational movement between the seat and back sections.

7 Claims, 6 Drawing Figures

Fig. 3
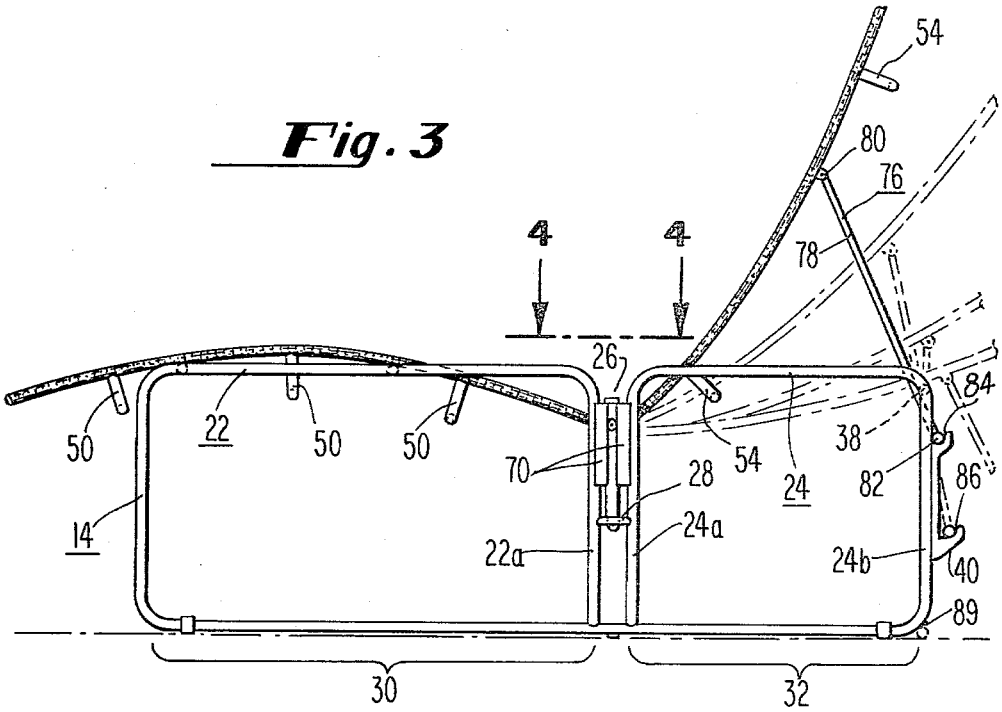
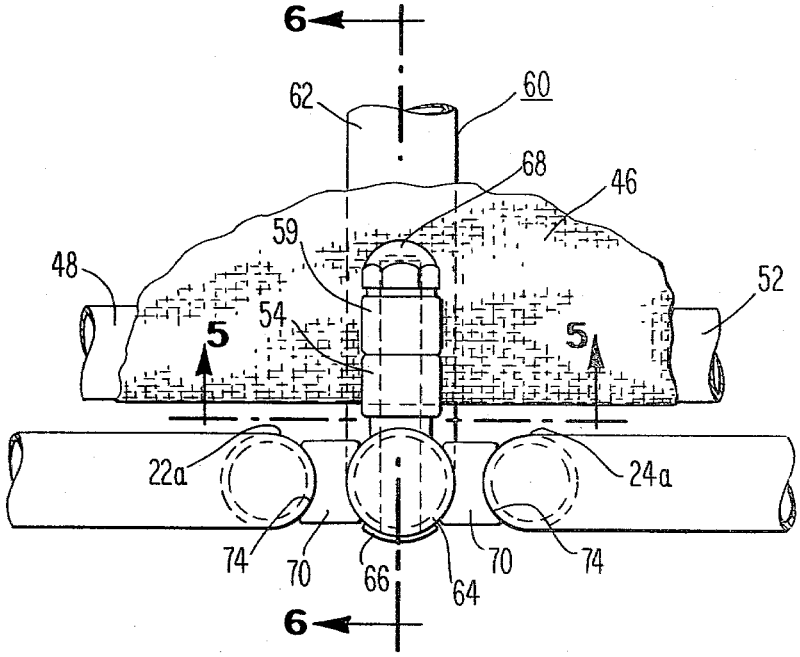
Fig. 4

Fig. 5
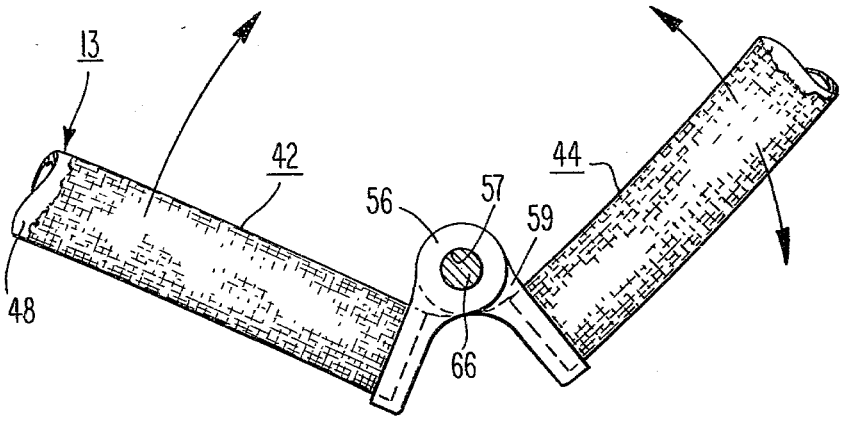
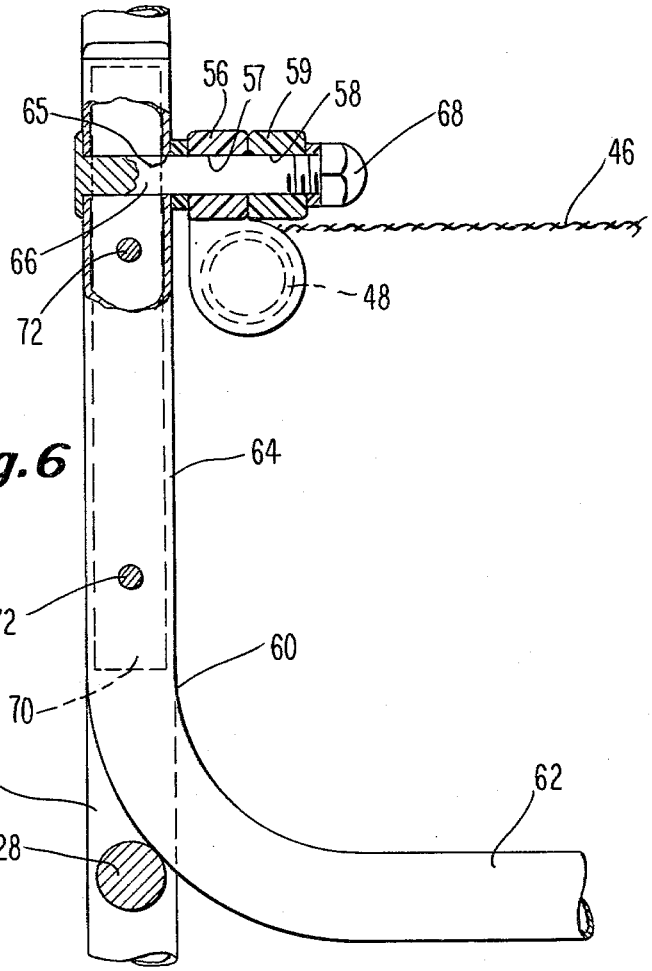
Fig. 6

ADJUSTABLE AND COLLAPSIBLE SEATING PIECE

TECHNICAL FIELD

This invention relates to a seating piece, and more particularly to an adjustable and collapsible seating piece, such as a chaise lounge.

Unless indicated to the contrary, all references to orientation location or position of the elements of the seating piece relate to the orientation, location or position when the seating piece is supported on a horizontal surface in an assembled condition ready for use.

BACKGROUND ART

Many different types of collapsible seating pieces have been described in the prior art. Collapsibility can be a very desirable attribute since it permits the seating piece to be packaged for shipment or storage in a more compact condition than when the seating piece is in its assembled condition. This can be particularly significant in large seating pieces, such as in chaise lounges.

However, it is a challenging objective to develop collapsible seating piece structures, such as chaise lounges, that can be assembled in a relatively easy manner into a high quality rigid construction while at the same time permitting relative motion between backrest and seat supporting sections thereof. It is to this type of construction that the present invention is directed.

The following patents are considered to be material to the subject matter of this application, and are being made of record herein pursuant to the requirements of 37 CFR 1.56.

U.S. Pat. No. 3,230,011 Propst
U.S. Pat. No. 3,378,259 Kupchinski
U.S. Pat. No. 3,655,239 Agosti
U.S. Pat. No. 3,754,788 Martini
U.S. Pat. No. 4,049,314 McGaffin
British Pat. No. 749,223
Austrian Pat. No. 191,118

The Propst patent discloses a seating piece having a seating section that is rotatable about an axle 20 to establish the proper position for connecting it to a base 30. However, the seating section is not adjustable after it is connected to the base. Moreover the base is not a foldable, or collapsible member.

The Kupchinski patent discloses an exercise cot formed by a frame assembly having two U-shaped halves 32 hinged together at the ends of their legs through connections 33. A U-shaped bracing bar is employed to strengthen the frame construction while lying away from the frame to eliminate any hard line across the center of the canvas covering.

The Agosti patent discloses a seating piece of the type that can be employed in theaters. This seating piece includes substantially identical backrest and seat sections which are pivotally connected to a fixed frame that is bolted to the floor.

The Martini patent discloses a seating piece having a separate base and seat section; however, the seat is not adjustable and the base is not foldable or collapsible.

The McGaffin patent discloses a unit in which a sling 30 is flexible, and in which the frame members can be assembled in different arrangements to form different types of seating pieces. However, once the sling 30 is connected to the frame members it is not adjustable into different fixed positions. In addition, the sling is not relied upon to maintain the supporting frames in an upright, or assembled condition.

The British patent discloses a chaise construction; however, the seating piece is not employed in any manner to maintain a foldable base frame in its operative condition. In fact the base frame is not foldable.

The Austrian patent is believed to be the most relevant one that applicant is aware of relating to the subject matter of the present invention. In the seating piece disclosed in this patent both the seating section and the supporting frame are separable from each other, and also are foldable. However, the seating section 14 does not include seat and back sections rotatably joined together to permit adjustability between them. When the seating section and base frame are connected the seating section cannot be adjusted into different fixed positions as is common in chaise lounge constructions.

DISCLOSURE OF INVENTION

In accordance with this invention a collapsible seating piece, preferably in the form of a chaise lounge, includes a foldable, or collapsible base unit that is separate from, but connectable to a foldable seating unit. In addition, the foldable seating unit includes seat and back sections rotatably joined together, and adjustable relative to each other into different fixed positions when the seating unit is assembled with the base unit.

The base unit of this invention includes lower support members and side frame members. The side frame members are rotatable into a generally horizontal and collapsed position, and into a generally vertical position. In the vertical position the side frame members are laterally spaced-apart from each other and are adapted to be assembled with the seating unit.

The seating unit is foldable about a rotatable axis joining the seat and back sections together. In addition, the seating unit includes a connecting member for releasably engaging side frame members of the base unit when the side frame members are generally vertically oriented to thereby connect the seating unit to the base unit. This connection also aids in retaining the side frame members in their vertical orientation, while permitting rotational movement between the seat and back sections of the seating unit into different positions relative to each other.

Most preferably the connecting member is a generally U-shaped bracing member that is rotatably connected to the same axles joining the seat and back sections together. The bracing member is provided with surfaces associated with its legs for slidably contacting spaced-apart vertical side frame members of the base unit to provide the releasable connection between the seating unit and the base unit.

A back adjustment arm is associated with the back section of the seating unit, and this arm is adapted to be retained in different positions to thereby establish different fixed positions between the seat and back sections of the seating unit.

Other objects and advantages of this invention will be apparent by referring to the following description of the best mode of this invention, taken in conjunction with the drawings.

BRIEF DESCRIPTION OF THE DRAWINGS

FIG. 3 is a side elevation view of the chaise lounge shown in FIG. 1, and indicating in both solid and phantom representation different fixed positions of the back section;

FIG. 4 is a plan view along line 4—4 of FIG. 3;

FIG. 5 is a sectional view along line 5—5 of FIG. 4; and

FIG. 6 is a sectional view along line 6—6 of FIG. 4.

BEST MODE FOR CARRYING OUT THE INVENTION

Figure 1:
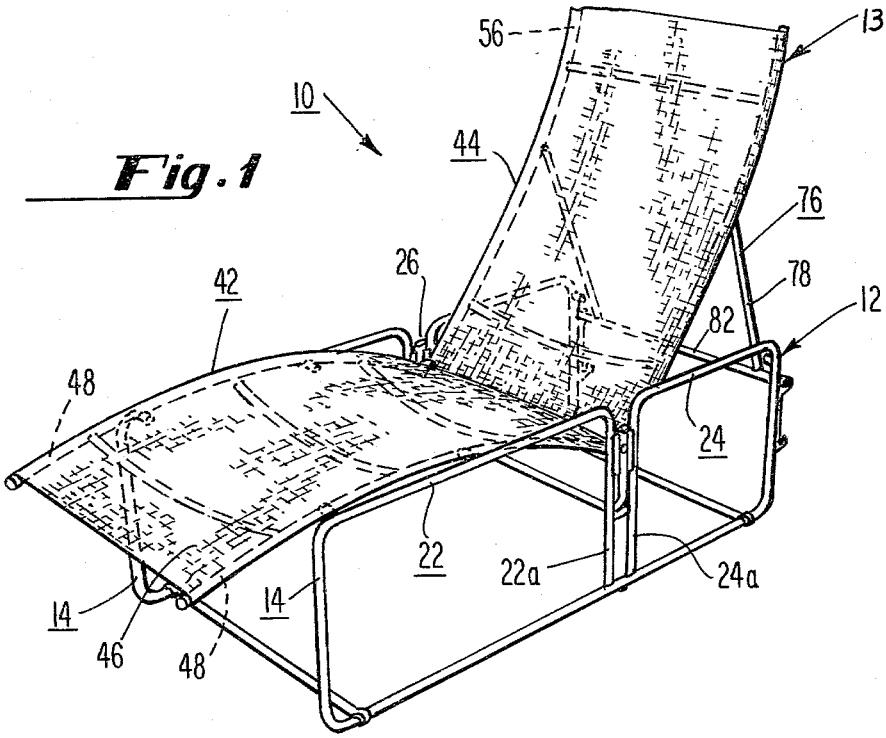
FIG. 1 is an isometric view of a collapsible chaise lounge in accordance with this invention, in an assembled condition.

Although specific terms are used in the following description for the sake of clarity, these terms are intended to refer only to the particular structure of the invention selected for illustration in the drawings, and are not intended to define or limit the scope of the invention.

Figure 2:
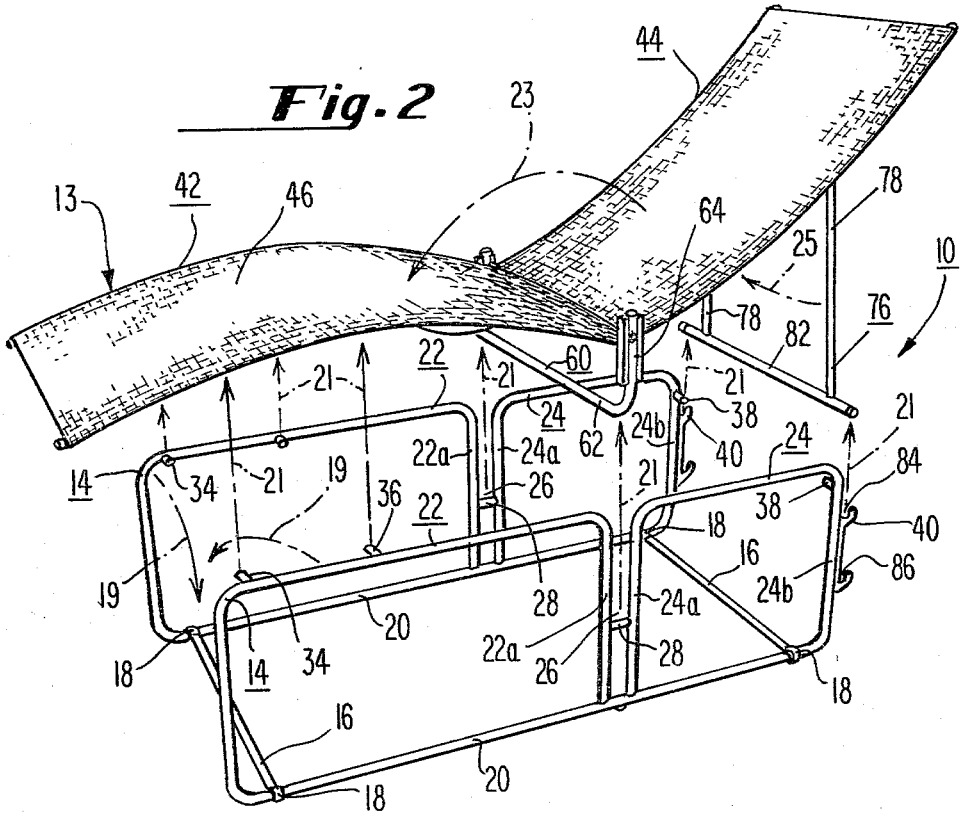
FIG. 2 is an isometric view showing the foldable seating unit and the collapsible base unit of the chaise lounge disassembled and ready to be folded.

Referring to FIGS. 1 and 2, an adjustable and collapsible seating piece is shown in the form of a chaise lounge 10. This unit includes a foldable, or collapsible base unit 12 and a separate, but connectable foldable seating unit 13.

Referring specifically to FIG. 2 the collapsible base unit 12 includes spaced-apart sides 14 rotatably joined to end base frames 16 through suitable clips 18. Arrows 19 indicate the manner in which the sides 14 are rotated to collapse the base unit 12 after the seating unit 13 has been separated by upward movement relative to the base unit 12, as indicated by the arrows 21.

Each clip 18 encircles a bottom horizontal frame section 20 of a side 14, and includes an interior rib engaging a swaged groove in said bottom frame section. This type of connection is similar to that disclosed in U.S. Pat. No. 4,112,855, issued on Sept. 12, 1978, assigned to Brown Jordan Company, and herein incorporated by reference. However, in the preferred construction of this invention each clip 18 completely encircles the horizontal frame 20, and has a split stem section retained within the end of its respective end base frame 16. It should be understood that the specific means for providing the rotatable connection is not considered to be limiting on the present invention.

Referring specifically to FIGS. 2 and 3 each of the sides 14 is further provided by generally U-shaped frame sections 22 and 24 formed as a continuous extension of the bottom horizontal frame section 20. These frame sections 22 and 24 include vertical tubular inner legs 22*a* and 24*a* that are welded to their respective bottom horizontal frame section 20 to complete the construction of each side 14. The spacing between the inner legs 22*a* and 24*a* establishes a channel 26; each channel being interrupted by a horizontal frame section 28 that is employed to properly position the seating unit on the base unit, as will be explained hereinafter.

As can be seen in FIGS. 1–3 the channel 26 in each side 14 is established closer to the back end of the base unit 12 to divide the base unit into a front section 30 that is longer than a rear section 32 (FIG. 3). As can be seen best in FIG. 2, rod-shaped projections 34, 36 and 38 extend inwardly from each side 14 adjacent the upper surface thereof to aid in the positioning of the seating unit 13, as will be explained hereinafter. Each of the sides 14 further includes a retaining bracket 40 connected to its rear vertical leg section 24*b* to aid in the adjustment of the seating unit 13, as also will be explained in greater detail hereinafter.

Referring to FIGS. 1 and 4 the seating unit 13 includes a seat section 42 and a back section 44. A mesh fabric 46 constitutes the body supporting surface of the seating unit. The seat section 42 includes laterally spaced-apart hollow tubular frames 48 that are reinforced by generally concave, or curved cross braces 50 (FIGS. 1, 3 and 4). These cross braces are maintained out of engagement with the mesh fabric 46 to avoid the formation of hard areas across the fabric that would interfere with the comfort of the user. The back section 44, similar to the seat section 42, is provided by a pair of laterally spaced-apart hollow tubular frames 52 that are reinforced by generally concave, or curved cross braces 54. These cross braces are also out of engagement with the mesh fabric, for the same reason indicated in connection with the cross braces 50.

The mesh fabric 46 is connected to the corresponding hollow frames 48 and 52 in substantially the same manner as in the folding chair construction described in U.S. Pat. No. 4,105,244, issues on Aug. 8, 1978, and assigned to Brown Jordan Company. This later patent is herein incorporated by reference. However, the manner in which the fabric is connected to the supporting frames does not form any part of the instant invention, and any other desired arrangement for connecting the fabric can be employed.

Referring specifically to FIGS. 4–6 the manner in which the rotatable connection is maintained between the seat section 42 and the back section 44 will be explained; the rotatable connection adjacent each lateral side of the seating unit 13 being the same. Each of the tubular frames 48 of the seat section 42 includes an upstanding lug 56 welded to it. This lug includes an opening 57 that is in axial alignment with an opening 58 formed in a similar upstanding lug 59 that is welded to an adjacent tubular frame 52 of the back section 44. This arrangement of aligned opening 57 and 58 can be seen best in FIG. 6.

Referring specifically to FIGS. 2, 4 and 6, a U-shaped connecting and bracing member 60 is provided to connect the seating unit 13 to the base unit 12, and also to increase the rigidity of the seating unit. This member 60 includes a generally horizontal section 62 extending across the entire lateral extent of the seating unit 13 and spaced below the body supporting fabric 46. In addition the member 60 includes upstanding vertical legs 64 that are each provided with an opening 65 aligned with the openings 57 and 58 in adjacent lugs 56 and 59 (FIG. 6). In order to establish the pivotal connection between the seat section 42 and back section 44 a pivot pin 66 is passed through the aligned openings 65, 57 and 58, and is retained within these openings through a threaded connection with a locking nut 68. This connection establishes an axle at each lateral end of the seating unit to permit relative rotational motion among the seat section 42, the back section 44 and the U-shaped member 60.

To establish the releasable connection between the seating unit 13 and the base unit 12, a pair of plastic retaining members 70 are connected to each of the legs 64 of the U-shaped member 60 by bolts 72, or other suitable connecting means (FIGS. 4 and 6).

The retaining members 70 connected to each leg 64 are diametrically opposed to each other, and include outer concave surfaces 74 that are aligned with, and contact the inner, generally convex surfaces of the tubular inner legs 22*a*, 24*a* (FIG. 4). The connection is made by sliding the retaining members 70 into the channels 26 in a vertical direction opposite to that indicated by the arrows 21 in FIG. 2. The plastic members 70 preferably are manufactured from a polyurethane plastic, and establish a firm engagement with the surfaces of the inner tubular legs 22*a* and 24*a* to provide an extremely rigid connection.

Referring to FIGS. 1–3, the construction of the seating piece 10 is completed by a back adjustment arm 76. This arm includes spaced-apart vertical members 78 pivoted to the laterally spaced-apart frames 52 of the back section 44. One such pivotal connection is shown at 80 in FIG. 3, it being understood that the other pivotal connection is identical. The end of each member 78 remote from its pivotal connection 80 is connected to a horizontal bar 82 that aids in establishing the desired fixed position of the back section 44.

Referring to FIG. 3, different positions in which the back section 44 can be positively retained are illustrated. The specific number of fixed positions in which the back section can be retained is not a limitation on the broadest aspects of this invention. However, it is preferred to construct the seating piece so that the back section is adjustable into at least two different fixed positions. In the solid line position shown in FIG. 3 the horizontal bar 82 is retained within an upper groove 84 established between each retaining bracket 40 and the vertical leg to which it is connected (FIGS. 2 and 3). The back section 44 can be positioned in its next lower position, as indicated in phantom lines, by positioning the horizontal bar 82 in a lower groove 86 provided in each of the retaining brackets 40. The next lower position is established by positioning the horizontal bar 82 on the surface supporting the chaise lounge, but extremely close to the rear vertical legs 24*b* of the base unit 12, as is shown at 89 in FIG. 3. The lowest position of the back section 44 is established by pulling the horizontal bar 82 outwardly, as is indicated at 90, to cause the laterally spaced-apart frames 52 of the back section 44 to engage, and be supported by the inwardly directed rod-shaped projections 38 (FIGS. 2 and 3).

The seating piece 10 is assembled for use by first rotating the sides 14 into a substantially vertical position; opposite to the direction indicated by arrows 19 in FIG. 2. Thereafter the generally U-shaped member 60 is rotated into a substantially vertical orientation, and the sides 14 can be manipulated as necessary to establish vertical alignment between the channels 26 and the retaining members 70 that are connected to the legs of the U-shaped member 60. Most preferably the seat section 42, the back section 44 and the adjustment arm 72 are collapsed, or folded together, as is indicated by arrows 23 and 25, respectively (FIG. 2), so that they all can be held as the retaining members 70 are slid into the channels 26 to frictionally engage the generally convex surfaces of the tubular inner legs 22*a* and 24*a*. The U-shaped member 60 is pushed downwardly, in a direction opposite to arrows 21, until its horizontal section 62, or a region close to it, engages the horizontal frame section 28 in each channel 26 (FIG. 6). Thereafter the seat section 42 and back section 44 are opened up to permit the seat section to come to its rest position on the inwardly directed projections 34 and 36. The back section can be permitted to fall into the position wherein its side frames 52 engage the inwardly directed projection 38, or alternatively, the adjustment arm 76 can be employed to establish a different position.

The strong frictional connection between the plastic retaining members 70 and the inner vertical legs 22*a* and 24*a* maintain the sides 14 of the base unit 12 in their vertically upright position. Moreover, this is accomplished without interfering with the ability to rotate, or pivot the back section 44 of the seating unit 13 relative to the seat section 42 to establish the desired orientation between said back and seat sections.

Although the invention has been described with a certain degree of particularity, it is understood that the present disclosure has been made only by way of example, and that numerous changes in the details of construction and in the combination and arrangement of parts may be resorted to without departing from the scope of the invention.

What I claim as the invention is:

1. A seating piece comprising:

a foldable base unit including lower support members and side frame members, said side frame members being rotatable into a generally horizontal, collapsed position, and into a laterally spaced-apart, generally vertical position;

a seating unit including a seat section and a back section rotatably joined together to permit said seat and back sections to be adjusted relative to each other, said seating unit including connecting means for releasably engaging side frame members when said side frame members are in their generally vertical position for releasably connecting the seating unit to the base unit without preventing rotational movement between the seat and back sections.

2. The seating piece of claim 1 wherein said connecting means includes retaining members having surfaces for slidably engaging spaced-apart, generally vertical side frame members to provide the releasable connection between the base unit and the seating unit, and to aid in maintaining the side frame members in their generally vertical position.

3. The seating piece of claim 1 wherein the connecting means includes surfaces that slidably engage the side frame members and conform in shape to the surfaces of the side frame members being so engaged.

4. The seating piece of claim 1 including adjustment means associated with the back section of the seating unit and retaining means associated with the base unit for receiving the adjustment means and permitting adjustment of the back section into at least two different fixed positions relative to the seat section.

5. The seating piece of claim 1 wherein the rotatable connection between the seat and back sections of the seating unit is provided by axles that also rotatably mount the connecting means.

6. The seating piece of claim 5 wherein said connecting means includes retaining members having surfaces for slidably engaging spaced-apart generally vertical side frame members to provide the releasable connection between the base unit and the seating unit and to aid in maintaining the side frame members in their generally vertical position.

7. The seating piece of claim 6 wherein the surfaces of the retaining members that slidably engage the side frame members conform in shape to the surfaces of the side frame members being so engaged.

* * * * *